United States Patent [19]

Atkinson et al.

[11] Patent Number: 4,779,358

[45] Date of Patent: Oct. 25, 1988

[54] QUICK MOUNTING, LOCATING AND SUPPORT ARRANGEMENT FOR NOZZLES FOR A WEB DRYING SYSTEM

[75] Inventors: Eugene C. Atkinson, Appleton; Robert S. Krueger, Winneconne; Leo A. VanOursouw, Kimberly; James M. Miller, Oshkosh, all of Wis.

[73] Assignee: Thermo Electron - Web Systems, Inc., Auburn, Mass.

[21] Appl. No.: 76,355

[22] Filed: Jul. 22, 1987

[51] Int. Cl.[4] ..... F26B 13/00

[52] U.S. Cl. ..... 34/156; 34/160

[58] Field of Search ..... 34/160, 156, 155; 226/97

[56] References Cited

U.S. PATENT DOCUMENTS 3,739,491 6/1973 Creapo et al. ..... 34/156

3,964,656 6/1976 Hella ..... 34/156 X 4,414,757 11/1983 Whipple ..... 34/155

*Primary Examiner*—Steven E. Warner

*Attorney, Agent, or Firm*—Lorusso & Loud

[57] ABSTRACT

A nozzle assembly for a web drying apparatus that can be quickly assembled and disassembled from the front or tending side of the web drying apparatus. At the rear of the web drying apparatus, instead of the normal bolt fastening system, a slidable connection is provided between the nozzle housing and the bulkhead. By manipulating the front end of the nozzle housing, nozzle mounting flanges secured to the rear end of the nozzle housing are slid under nozzle support clips on the bulkhead to secure the rear end of the nozzle housing to the bulkhead. Conventional systems are used to secure the front end of the nozzle housing. There may be one or two bulkheads in the nozzle assembly of the present invention.

6 Claims, 1 Drawing Sheet

QUICK MOUNTING, LOCATING AND SUPPORT ARRANGEMENT FOR NOZZLES FOR A WEB DRYING SYSTEM

BACKGROUND OF THE INVENTION

The present invention relates to a system for drying web material and more particularly, to a drying system utilizing nozzles which can be removed and/or adjusted conveniently and quickly.

For nearly two centuries, the dominant system for drying continuous webs has been a series of rotating steam heated cylinders. When drying surface coatings on paper webs, the alternating contact of the web with the metal cylinder results in picking and other quality defects. This problem was a primary stimulus for the development of flotation drying systems that simultaneously support and convectively dry the web on a cushion of high velocity hot air. In the past twenty years, flotation drying has evolved into the dominant method for drying coated webs.

With a typical flotation web drying installation, the drying is accomplished by an array of nozzles positioned on each side of the web. Heated air is transported to the nozzles by a system of headers to which the air is supplied through a duct. A similar duct collects the air after it leaves the vicinity of the web.

There are various types of nozzles used for flotation drying. One known type of nozzle, which is taught by U.S. Pat. No. 3,587,177, the teachings of which are incorporated herein by reference, utilizes a "negative" pressure gas cushion to support and dry the web. U.S. Pat. No. 4,414,757 teaches another known type of nozzle utilizing a "positive" pressure to float and dry the web and the teachings of this patent are also incorporated herein by reference. This nozzle also imparts an undulating web flow characteristic which is preferable for most drying applications, and such nozzles display very uniform machine-direction heat transfer. Positive pressure nozzles are tolerant of a very large range of web tension, and they allow the web to resist the formation of edge curl.

In laboratory research, development work, and in actual practice, it is desirable to be able to quickly mount, locate and change the nozzle housings. Normally, however, mounting bolts for assembly and disassembly are located at both the front and back end of the nozzle housing. While removal of the front mounting bolts is easily accomplished, it is extremely difficult to reach the mounting bolts at the back of the nozzle housing. Assembly and disassembly is therefore hampered.

Moreover, when mounting bolts secure both the front and the back end of the nozzle housing, the nozzle housing expansion may be restricted upon heatup of the dryer. The nozzles may become bowed. The nozzles can bow toward the web or product being dried as the web passes through the gap between opposed nozzles. Consequently, the web may rub on the nozzles causing the web to tear and break resulting in shut down of the machine and loss of production time.

Accordingly, it is an object of the present invention to provide a nozzle assembly for use in flotation drying systems which can be quickly assembled and disassembled.

It is another object of the present invention to provide an improved apparatus and method to secure a nozzle housing to the supply bulkhead in a flotation drying system.

Still another object of the present invention to provide a nozzle assembly for flotation drying systems that facilitates nozzle expansion upon heatup of the dryer and therefore reduces the possibility of nozzle bowing.

SUMMARY OF THE INVENTION

The flotation drying system of the present invention utilizes nozzles having means for quick assembly and disassembly of the system. The nozzle assembly comprises a supply header or bulkhead which supplies a gas (typically air) through an orifice or port in one face of the bulkhead to form a linear jet. A nozzle housing extends across the face of the bulkhead in a direction perpendicular to a longitudinal axis of the face of the bulkhead and is secured to the bulkhead. The nozzle housing has a port connecting it to the orifice or port in the face of the bulkhead so that a stream of air travels from the bulkhead through the nozzle housing and is applied to the web for drying. The connection of the rear of the nozzle housing to the bulkhead can be made and released from the tendng side of the web drying system. Preferably, the connection is a slidable connection. The only mounting bolts are at the tending or front of the nozzle housing and the web drying system where the bolts can be easily manipulated. The method and apparatus of the present invention is useful with nozzle assemblies comprising one or more than one bulkhead.

These and other features and objects of the present invention will be more clearly understood from the following detailed description which should be read in light of the accompanying drawings in which corresponding reference numerals refer to corresponding parts throughout the several views.

DETAILED DESCRIPTION OF THE PREFERRED EMBODIMENT

Figure 1:
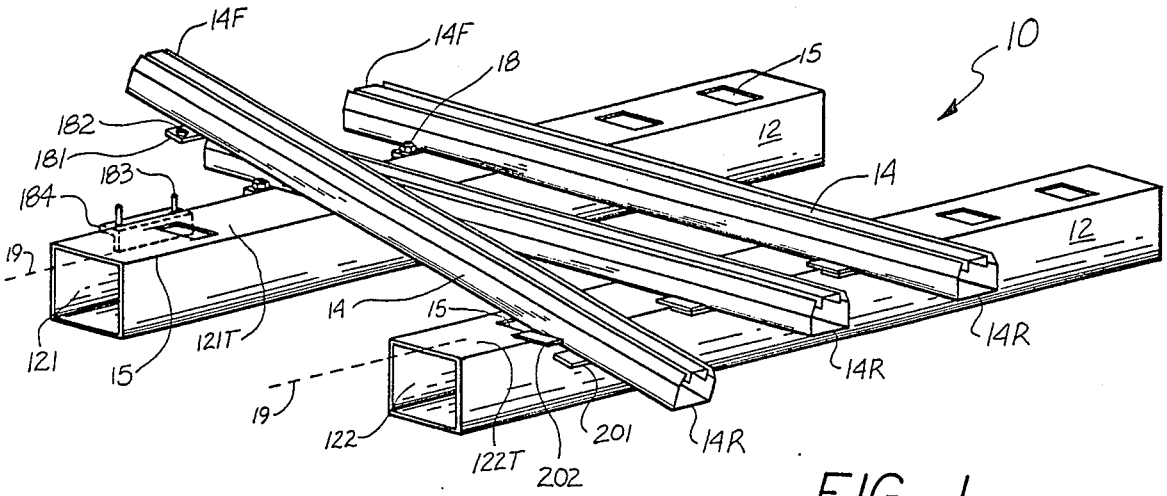
FIG. 1 is a plan view of one embodiment of the quick mounting, locating and support arrangement of the present invention.
Figure 2:
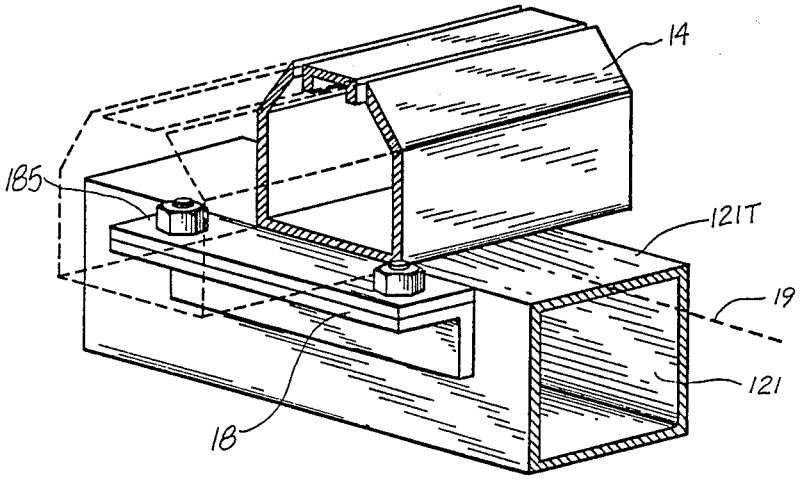
FIG. 2 is a plan view of a portion of the assembled nozzle assembly of the embodiment of the present invention shown in FIG. 1, illustrating the connection at the front of the web drying system.
Figure 3:
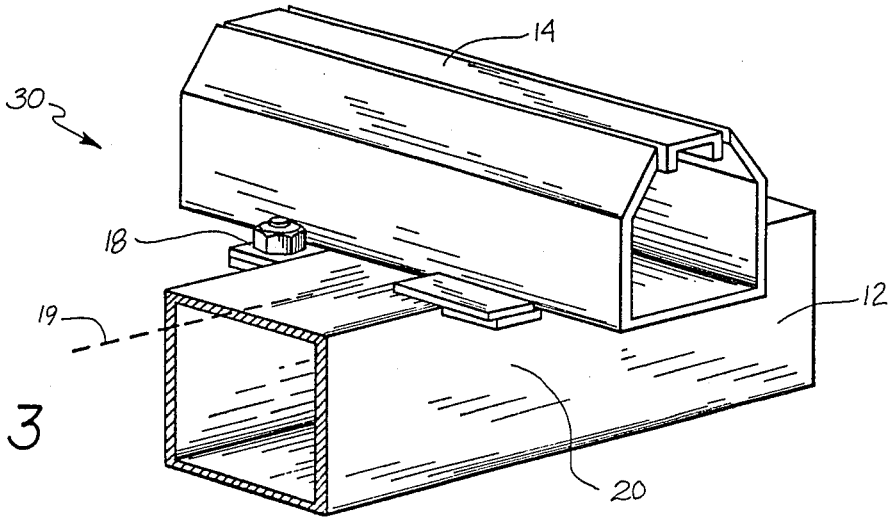
FIG. 3 is a plan view of another embodiment of the assembled nozzle assembly of the present invention.

The nozzle assembly of the present invention may include one bulkhead, as shown in FIG. 3, or more than one bulkhead, as shown in FIGS. 1 and 2.

A nozzle assembly 10 of the present invention, as shown in FIGS. 1 and 2, includes a number of supply headers or bulkheads, each generally designated "12". The bulkheads 12 will be positioned one after the other from the front to the back of the web drying system and will generally be parallel to each other. FIG. 1 shows a view of the nozzle assembly of the present invention in which there are two bulkheads 12. The bulkhead at the front of the web drying system is designated "121", and the bulkhead at the rear of the web drying system is designated "122". This type of nozzle mounting is generally intended for dryers with a maximum of two bulkheads, one bulkhead near the front and one bulkhead toward the back of the web drying system. The removal and reassembly of the nozzle mounting is easily accomplished by one person.

The nozzle assembly 10 further comprises a nozzle housing 14 having a port (not shown) through a bottom surface of the nozzle housing 14 that communicates with a port 15 in the bulkhead 12, a bolt system 18 to connect the front end 14F of the nozzle housing 14 to the bulkhead 121 at the front of the web drying system and a fastening system 20 that can be quickly and easily assembled and disassembled from the tending side of the web drying apparatus to connect the back end 14R of the nozzle housing 14 to the rear bulkhead 122.

The bulkhead 12 as used in the present invention is generally a low pressure (typically 3 to 16 inches of water column) gas supply header. The bulkheads 12 provide a plurality of gas supply ducts (not shown) which conduct the gas supply to the linear slot jet 16 in the nozzle housing 14 which produces a sheet of high velocity flow (typically 7,000 to 14,000 ft/min) directed toward the web.

Specifically with respect to this embodiment, the nozzle housing 14 extends across the faces 121T and 122T of the bulkheads 121 and 122, respectively, which are preferably rectangularly shaped. The nozzle housing 14 extends in a direction perpendicular to a central longitudinal axis 19 of the bulkheads 121 and 122. A nozzle housing 14 conducts the gas stream under pressure to the web and will have a port (not shown) communicating with a corresponding port 15 on the faces 121T and 122T of the bulkheads 121 and 122 respectively. Gas passes from the port 15 in bulkhead 12 through the nozzle housing port into the nozzle housing 14, from which it is conducted under pressure to the web.

Fastening systems are required to connect the nozzle housing 14 to the bulkheads 12. The fastening system at the front of the web drying system 18 can be any conventional fastening system because the fastening system at the front or tending side of the system 18 is easy to reach and manipulate. A bolt system 18, as is conventional in the presently known web drying systems, is preferred and is shown in the figures.

This bolt system 18 is illustrated disassembled in FIG. 1 and assembled in FIG. 2 (the front of the nozzle housing 14 is shown in phantom so that the fastening system 18 can be seen assembled). A nozzle mounting flange 181 is secured to the front end 14F of the nozzle housing 14 at the point at which the nozzle housing 14 crosses the bulkhead 121. The nozzle mounting flange 181 will have two holes 182, one spaced at a distance from each end. The hole at each end 182 is positioned and sized to slip over nozzle mounting studs 183 which are connected to the bulkhead 121 and positioned to correspond to holes 182 in the nozzle mounting flange 181. The nozzle mounting studs 183 are placed on an L-shaped flange 184 extending from the bulkhead 121 and shown in phantom in FIG. 1. To assemble this fastening system, the holes 182 in the nozzle mounting flange 181 are positioned to receive the nozzle mounting studs 183 and a bolt 185, shown in FIG. 2, will be fastened and tightened to secure the fastening system 18.

At the rear of the dryer, the fastening system 20 to connect the nozzle housing 14 to the bulkhead 12 must be easy to manipulate. In the present invention, the fastening system 20 can be connected and released from the front or tending side of the web drying system. Another nozzle mounting flange 201 is connected and secured to each edge of the bottom surface near the rear end 14R of the nozzle housing 14 at the point it crosses the rear bulkhead 122. The nozzle mounting flange 201 on each side of the nozzle housing is positioned to slidably connect with nozzle support clips 202 attached to the supporting face 122T of the rear bulkhead in the web drying apparatus. The nozzle mounting flange 201 will slip under a nozzle support clip 202 to releasably secure the nozzle housing 14 to the bulkhead 122.

To assemble the nozzle assembly 10 of the present invention, a nozzle housing 14 is placed in position extending across the faces 121T and 122T of the bulkheads, in a direction perpendicular to a longitudinal axis 19 of the bulkheads 121 and 122. Working from the tending or front side of the web drying system, the operator lifts the front end 14F of the nozzle housing 14 and slides the rear end 14R towards the back of the system. The nozzle mounting flanges 201 will then be positioned behind and below the nozzle support clips 202 on the rear bulkhead 122. By lowering the front end 14F of the nozzle housing 14 slightly and sliding the nozzle housing 14 towards him, the operator will slide the nozzle mounting flanges 201 under the nozzle support clips 202 and the connection of the rear end 14R of the nozzle housing 14 is made. The operator then lowers the front end 14F of the nozzle housing 14 until the holes 182 in the nozzle mounting flange 181 are fitted around the nozzle mounting studs 183 on the L-shaped flange 184 extending from the bulkhead 121. Bolts 185 are placed over the nozzle mounting studs 183 and nozzle mounting flange 181 and tightened to secure the front end 14F of the nozzle housing 14 to the bulkhead 121.

A second embodiment of the present invention is shown assembled in FIG. 3, in which there is only one bulkhead 12 in the nozzle assembly 30. In this embodiment, the nozzle housing 14 will be attached at its front end 14F with the bolt system 18 at its rear end 14R with the slidable connecting system 20 to the same bulkhead 12. In all other respects, the embodiments are similar.

While the foregoing invention has been described with reference to its preferred embodiments, various alterations and modifications will occur to those skilled in the art. All such alterations and modifications are intended to fall within the scope of the appended claims.

What is claimed is:

1. A nozzle assembly for a web drying apparatus for producing quick assembly and disassembly thereof, comprising:

at least one means for conducting a gas steam under pressure having a supporting face including at least one port through which gas is directed, said at least one means for conducting a gas stream under pressure lying in a first direction, said means for conducting a gas stream under pressure being arranged in a parallel manner from the front to the back of the web drying apparatus;

a nozzle housing extending in a second direction across said supporting face of said at least one means for conducting a gas stream under pressure, said second direction being perpendicular to said first direction, one end of said nozzle housing facing the front of the web drying apparatus and the other end of said nozzle apparatus facing the rear of said web drying apparatus, said nozzle housing having ports communicating with said ports in each of said at least one means for conducting a gas stream under pressure;

a first fastening system for slidably connecting said nozzle housing to the one of said at least one means for conducting a gas stream under pressure that is positioned at the rear of said web dryer apparatus comprising a nozzle mounting flange positioned on said nozzle housing at the rear end of said nozzle housing and nozzle support clips positioned on the face of said means for conducting a gas stream under pressure that is positioned at the rear of the web drying apparatus, said nozzle mounting flange sliding under said nozzle support clips to secure the rear end of said nozzle housing; and a second fastening system for releasably securing said nozzle housing to the one of said at least one means for conducting a gas stream under pressure that is positioned at the front of said web drying apparatus;

whereby assembly and disassembly of the rear end of the nozzle assembly can be performed from the front of the web drying apparatus by lifting the front end of the nozzle housing, sliding the nozzle housing down and towards the back of the web drying apparatus, lowering the nozzle housing and pulling it forward to slidably connect said first fastening system.

2. The nozzle assembly of claim 1 wherein said second fastening system comprises a second nozzle mounting flange having a hole positioned a distance from each end and positioned on said nozzle housing at the front end of said nozzle housing and nozzle mounting studs positioned on a member extending towards the front of the web drying apparatus from said at least one means for conducting a gas stream under pressure that is positioned at the front of said web drying apparatus and positioned to fit within the holes on either end of said second mounting flange, wherein further means are provided to secure the nozzle mounting studs in the holes on said second nozzle mounting flange.

3. A nozzle assembly for a web drying apparatus for producing a quick assembly and disassembly thereof, comprising:

at least one means for conducting a gas stream under pressure having a supporting face including at least one port through which gas is directed, said at least one means for conducting a gas stream under pressure lying in a first direction, and positioned parallel to the next of said at least one means for conducting a gas stream under pressure from the front to the back of the web drying apparatus;

a nozzle housing extending in a second direction across said supporting face of said at least one means for conducting a gas stream under pressure, said second direction being perpendicular to said first direction, said nozzle housing having a port communicating with said ports in each of said at least one means for conducting a gas stream under pressure, one end of said nozzle housing facing the front of the web drying apparatus and the other end of said nozzle housing facing the rear of the web drying apparatus;

nozzle mounting flanges positioned on the bottom surface of the rear end of said nozzle housing at each edge of the bottom surface;

two nozzle support clips secured to said at least one means for conducting a gas stream under pressure at the rear of the web drying apparatus, said clips positioned on opposite sides of said at least one means for conducting a gas stream under pressure, and positioned to cooperate with said nozzle mounting flanges for slidably securing said nozzle mounting flanges;

a second nozzle mounting flange, positioned at the front end of said nozzle housing, said second nozzle mounting flange having two holes, each a distance from each end of said second nozzle mounting flange;

two nozzle mounting studs secured to the at least one means for conducting a gas stream under pressure at the front of the web drying apparatus and positioned to fit in the holes a distance from each end of said second nozzle mounting flange; and means to secure the nozzle mounting studs in the holes a distance from each end of said second nozzle mounting flange.

4. A nozzle assembly for a web drying apparatus for producing quick assembly and disassembly thereof, comprising:

a means for conducting a gas stream under pressure having a supporting face including at least one port through which gas is directed, said at least one means for conducting a gas stream under pressure lying in a first direction and having one face positioned towards the front of the web drying apparatus and an opposite face positioned towards the rear of the web drying apparatus;

a nozzle housing extending in a second direction across said supporting face of said means for the conducting a gas stream under pressure, said second direction being perpendicular to said first direction, one end of said nozzle housing facing the front of the web drying apparatus and the other end of said nozzle housing facing the rear of said web drying apparatus, said nozzle housing having a port communicating with said port in said means for conducting a gas stream under pressure;

a first fastening system for slidably connecting the rear end of said nozzle housing to said at least one means for conducting a gas stream under pressure comprising nozzle mounting flanges positioned on the rear end of said nozzle housing and two nozzle support clips secured to the supporting face of said means for conducting a gas stream under pressure and under which said nozzle mounting flanges slide to releasably secure the rear of said nozzle housing; and a second fastening system for releasably securing the front end of said nozzle housing to said means for conducting a gas stream under pressure;

whereby assembly and disassembly of the nozzle assembly of the web drying apparatus can be performed from the front of the web drying apparatus by lifting the front end of said nozzle housing, sliding the nozzle housing down and back towards the rear of the web drying apparatus, lowering the nozzle housing slightly and pulling the nozzle housing forward to slidably connect said first fastening system.

5. The nozzle assembly of claim 4 wherein said second fastening system is a second nozzle mounting flange having a hole positioned a distance from each end, said second nozzle mounting flange positioned on the front end of said nozzle housing and nozzle mounting studs positioned on a member extending from the face of said means for conducting a gas stream under pressure that faces the front of the web drying apparatus, said nozzle mounting studs positioned to fit wihtin the holes on either end of said second mounting flange, wherein further means are provided to secure the nozzle mounting studs in the holes on said second nozzle mounting flange.

6. A method for quick assembly of a nozzle assembly of a web drying apparatus comprising:

providing at least one means for conducting a gas stream under pressure having a supporting face including at least one port through which gas is directed, said at least one means for conducting a gas stream lying in a first direction and positioned parallel to the next of said at least one means for conducting a gas stream under pressure from the front to the back of the web drying apparatus;

providing a nozzle housing extending in a second direction across said supporting face of said at least one means for conducting a gas stream under pressure, said second direction being perpendicular to said first direction, said nozzle housing having a port communicating wth said ports in each of said at least one means for conducting a gas stream under pressure, one end of said nozzle housing facing the front of the web drying apparatus and the other end of the said nozzle housing facing the rear of the web drying apparatus;

slidably connecting the rear end of the nozzle housing to the at least one means for conducting a gas stream under pressure that is at the rear of the web drying apparatus by providing a first fastening system including nozzle mounting flanges positioned on the bottom surface of the rear end of said nozzle housing, at the edges of said bottom surface; and two nozzle support clips secured to said at least one means for conducting a gas stream under pressure at the rear of the web drying apparatus, said clips positioned on opposite sides of said at least one means for conducting a gas stream under pressure and positioned to cooperate with said nozzle mounting flanges;

lifting the front end of said nozzle housing;

sliding the nozzle housing down and back towards the rear of the web drying apparatus until the nozzle mounting flanges are below and behind said nozzle mounting clips;

lowering the front end of said nozzle housing; and sliding the nozzle housing forward so that the nozzle mounting flanges slide under and are secured by said nozzle mounting clips; and releasably securing the front end of the nozzle housing to the at least one means for conducting a gas stream under pressure that is at the front of the web drying apparatus.

* * * * *